United States Patent [19]

Pike

[11] 3,978,558

[45] Sept. 7, 1976

[54] AIR JET YARN ENTANGLEMENT

[75] Inventor: Herbert J. Pike, Martinsville, N.J.

[73] Assignee: J. P. Stevens & Co., Inc., New York, N.Y.

[22] Filed: Jan. 12, 1976

[21] Appl. No.: 647,946

[52] U.S. Cl. ..... 28/1.4; 28/72.12

[51] Int. Cl.[2] ..... D02G 1/16

[58] Field of Search ..... 28/1.4, 72.12; 57/34 B, 57/157 F

[56] References Cited

UNITED STATES PATENTS

| | | | |
|---|---|---|---|
| 3,810,285 | 5/1974 | Ferrier et al. | 28/72.12 X |
| 3,822,543 | 7/1974 | Edagawa et al. | 28/1.4 X |
| 3,831,363 | 8/1974 | Pike | 57/34 B |
| 3,914,929 | 10/1975 | Adachi et al. | 28/1.4 X |

*Primary Examiner*—Louis K. Rimrodt

*Attorney, Agent, or Firm*—Michael T. Frimer; Robert A. Norton; Charles Stein

[57] ABSTRACT

Yarn is treated in an air entangling apparatus having a yarn passageway through which one or more multifilament yarns are fed and an air inlet duct intercepting the bottom of said passageway at right angles, the longitudinal axis of the inlet duct passing through or close to the longitudinal axis of the yarn passageway. A jet of air is introduced into said passageway and strikes the upper wall thereof forming a plural vortex turbulent zone in the upper portion of the yarn passageway which entangles the multifilament yarns. An air outlet duct intercepts the top of the yarn passageway and serves to create an air flow which holds the yarn in the upper portion of the passageway. Yarn is fed into the passageway with a small degree of overfeed, generally from about 0.1 to 10%. A structure, such as a rod, extends into the yarn passageway and contacts the yarn fed therethrough. The resistance to yarn movement resulting from this contact creates yarn slack in the area of the turbulent zone.

6 Claims, 3 Drawing Figures

AIR JET YARN ENTANGLEMENT

BACKGROUND OF THE INVENTION

A number of apparatuses for treating multifilament yarn with air jets were known in the past. In many of the apparatuses, the air entering is introduced into a chamber or bore at an angle to the travel of yarn in a path that intersects the axis of the bore and this air jet results in fluttering or oscillation of the yarn which effects an entanglement or interlacing of the filaments. In others, the air introduction into the chamber or bore is tangential so that the air column whirls around the chamber or bore and imparts twist to the yarn.

Examples of air jet apparatuses in which air is introduced tangentially are my earlier U.S. Pat. Nos. 3,653,196, Apr. 4, 1972; 3,700,391, Oct. 24, 1972; and 3,831,363, Aug. 27, 1974. In each of my three patents the whirling air stream causes the yarn which is introduced to spin in the form of one or more loops similar in appearance to a jumping rope. This introduces a large amount of torque which is relieved with an abrupt change in direction around a rod to produce extremely effective texturization. Very substantial overfeed of the yarn going into the texturizing chamber is required.

A typical example of an interlacing or entanglement air jet is disclosed in U.S. Pat. No. 3,824,776 to London. In this patent, one or more multifilament yarns are pretexturized and then passed through a bore of an air jet apparatus in a straight path which follows the axis of the bore. Air at relatively high pressure is introduced into the bore at an angle of 45° – 75° with the air flow in the bore being cocurrent with the yarn direction. The patent describes only the use of pretexturized yarn and produces non-uniform, intermittent entanglement with nodal points between portions which are fluffed out. The non-uniform entanglement apparently somewhat resembles tiny sausage links or beads.

Another patent belonging to the same group is the U.S. Pat. No. 2,942,402 to Palm. One of the critical features of the invention is that there is a significant amount of leakage of air back through the yarn guide even though this is filled to a considerable extent by yarn. In Palm the yarn is fed to the bore with substantial overfeed and moves through the bore along a path which follows the axis of the bore. The product produced by Palm is voluminous and contains loops of individual filaments which project from the main body of the yarn.

My co-pending U.S. application Ser. No. 607,129, filed Aug. 25, 1975 relates to an improved air entangling apparatus in the form of a block in which an air jet enters a central bore at substantially right angle thereto. The bore extends all the way through the block and preferably has a uniform cross section so that air leaves at both ends of the bore. The incoming air jet strikes the upper wall of the central bore at a point opposite to the point of air introduction and splits to form two vortices in the upper portion of the central bore. Yarn introduction into the central bore is upstream from the air jet and is at an angle so that the yarn moves to the top of the turbulent air stream in the area of formation of the air vortices, where it oscillates back and forth across the stream. The yarn moves for a short distance countercurrent to the air leaving the upstream end of the central bore and then cocurrent with the air stream leaving the other end of the bore.

The angled introduction of the yarn and the countercurrent air flow urge the yarn toward the top of the bore and hold the yarn in the upper portion of the bore in the area of formation of the air vortices.

SUMMARY OF THE INVENTION

The present invention is directed to an air jet apparatus for the production of an entangled yarn which gives improved performance over the apparatus described in my co-pending U.S. application Ser. No. 607,129. It is believed that the improvement primarily results from a structural design which creates a stronger force holding the yarn in the area of formation of the air vortices. Using the apparatus of the present invention it is possible to obtain the same amount of entanglement at a given air pressure while feeding yarn at a higher rate, thus obtaining a higher production rate than with the apparatus of my co-pending application. Additionally, the apparatus of the present invention gives better results than my previous apparatus when the yarn to be treated is made of coarse or stiff filaments such as glass filaments.

According to the present invention, there is a central bore which serves as a yarn passageway extending through a block of metal or plastic with an air inlet duct intersecting the bore at approximately right angles. Yarn is introduced at the upstream end of the central bore and this end has a smaller cross section than the bore has in the area of the air inlet intersection. An upward slanting air outlet intercepts the bore upstream from the air inlet intersection in the area of the bore having a larger cross section than the upstream end of the bore. The air outlet duct preferably has a cross section which is greater than that of the upstream or entrance end of the central bore. This, plus the fact that part of the upstream end of the bore is filled with incoming yarn results in a substantial portion of the air exiting through the air outlet duct while only a small amount of air leaves through the upstream end of the central bore.

The bore or yarn passageway is partially blocked by a smooth, rounded surface extending into the bore between the air inlet duct and the exit end of the bore so as to contact yarn fed through the bore. The yarn is fed into the central bore with a small degree of overfeed, such as from 0.1 to 10% and the resistance to the forward movement of the yarn resulting from contact with the rounded surface extending into the bore serves to concentrate the yarn slack in the central bore upstream from the rounded surface in an area that includes the air inlet intersection. To minimize wear on the surface contacted by the yarn, it is preferably made of a hard, durable material such as hardened steel which may differ from the material used in the remainder of the device. Particularly good results are obtained when the rounded surface is provided by an adjustable rod of hard, durable material which extends into the central bore and can be shifted so that different portions of its surface are subjected to wear or can be entirely replaced.

The axis of the air inlet duct goes through or close to the center of the central bore. As a result, the incoming air jet strikes the upper wall of the central bore at a point opposite to the point of air introduction and the air jet splits to form two vortices in the upper portion of the central bore. It is in the area of these vortices that most of the desired entanglement occurs and this area is hereafter referred to as the entanglement zone. The flow of air through the air outlet duct creates a force which holds the yarn in the upper portion of the central bore in the entanglement zone. The cross section of the central bore is greater in the entanglement zone than at its upstream end and this increased cross section can continue through to its downstream end or, if desired, the area of the central bore downstream from the rounded yarn contact surface (e.g., rod extending into the central bore) can be further enlarged. While the cross section of the central bore in the entanglement zone can be larger than that of the air outlet duct, air flow out of the exit end of the central bore is partially blocked by both the presence of yarn and the rounded yarn contact surface so that the air flow through the air outlet duct is generally greater than the air flow out the exit end of the central bore.

The substantial flow of air through the air outlet duct is an important feature of the present invention. The air outlet duct intercepts the central bore at a point which is upstream from the air inlet duct and on the opposite side of the bore from the air inlet duct. For the purposes of the present description and claims, the air inlet duct interception shall be designated as being on the bottom of the central bore and the air outlet duct shall be designated as being on the top of the central bore even though it is possible to orient the apparatus in different positions. The air outlet duct slants upward from the central bore with the slant being in the upstream direction so that the axis of the air outlet duct and the axis of the central bore intersect at an acute angle within the range of about 30° to 75°. The air flow through the outlet duct creates a relatively strong force holding the yarn in the upper portion of the bore in the area of formation of the air vortices. The air jet causes the yarn to oscillate from side to side in the upper portion of the bore from one air vortice to the other. This effects entanglement of the yarn filaments, and since the vortices rotate in opposite directions any false twisting is alternately in opposite directions so that the yarn product does not possess any torque. This oscillation from side to side and minimizing of any false twist is in marked contrast to my earlier issued patents which have been referred to above and which have a very high false twist.

A very small degree of overfeed is used, for example from about 0.1% to about 10%. This is quite small compared with the overfeed used in the Palm patent and prevents the formation of a highly voluminous yarn having loops of individual filaments projecting from the yarn. The preferred product of the present invention is an entangled or interlaced multifilament yarn which has a relatively small amount of bulking. The bulking is sufficient to significantly improve the hand of fabrics produced from the treated yarn and the absence of protruding loops greatly reduces the problems encountered in handling the yarn in fabric producing apparatuses such as knitting machines and looms.

With the apparatus of the present invention results can be varied by using different yarns and, of course, results vary also with air pressure, feed of yarn, and the like. Very high outputs, from 125 yards per minute up to a maximum of about 1250 yards per minute have been obtained. In general, at the highest speeds, higher air pressures are required. When the yarn speed is in the range of about 125 to 400 yards per minute, the air pressure should be maintained within the range of about 6 to 20 psig. At higher speeds, it is possible to use higher air pressure without over entangling the yarn.

Thus, at 1200 yards per minute satisfactory products have been obtained with air pressures as high as 60 psig.

While not critical, air orifice diameters normally run from about 3/32 inches to 3/64 inches. The optimum orifice size will vary somewhat with the air pressure and with the rate of yarn feed.

The apparatus of the present invention can be used to entangle so-called flat yarns, that is to say, yarns which have not been texturized before they are introduced into the apparatus, as well as pretexturized yarns. When flat yarns are used the entangled product is generally uniform in appearance. With pretextured yarns, the product is generally uniform in appearance when low air pressures or high speeds are employed, but when a combination of higher pressures and slower speeds (e.g., 125 yards per minute and 30 psig air pressure) are used the products contain areas of high entanglement separated by areas of lower entanglement. Whether or not a uniform product is prepared depends on the desired appearance of the fabric to be produced from the yarn. It should be noted that the uniformity which is referred to is a visual appearance and not a microscopic examination of the final yarn.

While the apparatus of the present invention and its process can be used with a single multifilament yarn, it is preferred to use a plurality of yarns, two or more yarns and in some cases as many as five to obtain a plied yarn product. The yarns need not be the same and may vary in color, dyeability or other characteristics so that a variety of visual effects and physical property combinations can be obtained. The present invention can be used to combine multifilament yarns with stretch yarn. In such cases the products obtained may resemble somewhat products that are obtained by combining stretch yarn with multifilament yarns using conventional twisters. The air entanglers of the present invention can be very much more compact, cubical blocks of less than two inches on a side being suitable, and so in such cases the plied yarn product is obtained with a much more economical apparatus.

DESCRIPTION OF THE PREFERRED EMBODIMENT

Figure 3:
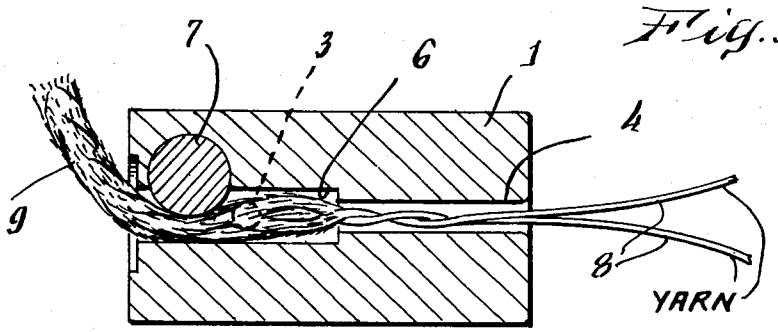
FIG. 3 is a plan view of the top of the texturizer.

A block is shown at 1 with threaded air introduction duct 2, air inlet duct 3, a yarn passageway which includes a section 6 in which yarn is entangled and a yarn inlet section 4 of smaller cross section, and slanting air outlet 5. A rod 7 extends across entanglement section 6 of the yarn passageway, but off center. Both sections 4 and 6 of the yarn passageway have circular cross sections.

The drawings do not show connections to compressed air, yarn introducing rolls for the plurality of yarns, for example two to five, nor the windup roll. These mechanisms are not changed by the present invention and to illustrate them would only confuse the drawings.

The yarns pass through the yarn inlet 4, through the entanglement section 6 and then travel across the rod 7 and out to takeup rolls. The blast of air going out the inclined air outlet duct 5 picks up the yarns as they come in and positively blows them to the top of the turbulent air flow. Top and bottom are indicated on the drawings by legend although it is to be understood that the apparatus can be oriented in different positions. This positive blowing up of the yarns to the top of the stream is one reason for the enhanced speed of throughput of the yarns and also is what permits satisfactory entanglement of relatively heavy and stiff yarns. It will be noted that the slanted air outlet 5 has a larger bore than the yarn inlet 4, which is also partially filled by the yarn passing through the apparatus.

Figure 2:
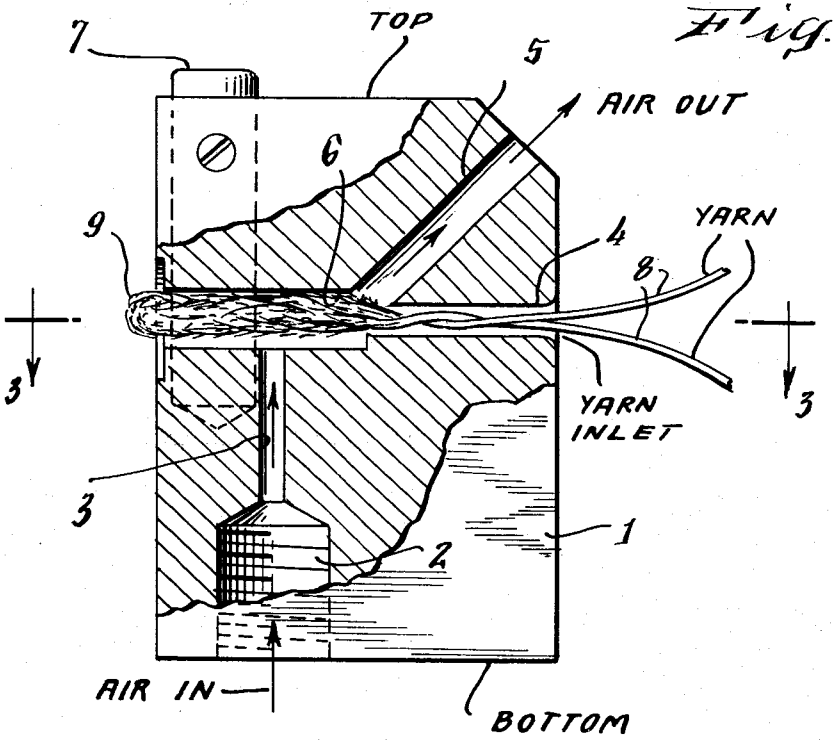
FIG. 2 is a vertical cross section partially broken away taken parallel to the yarn passageway.
Figure 1:
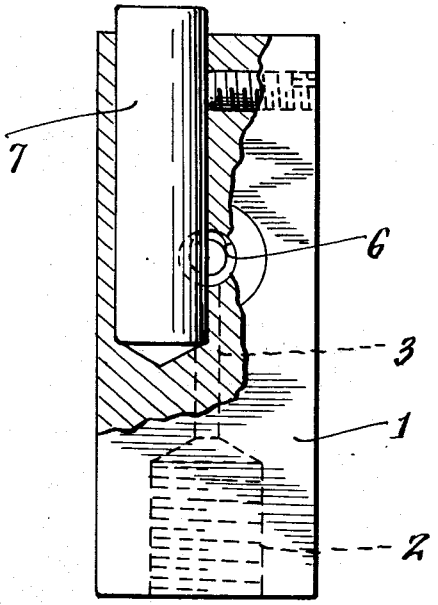
FIG. 1 is a vertical cross section partially broken away, taken at 90° to the yarn passageway.

In FIG. 2 in order to illustrate the operation two yarns 8 are shown passing through the apparatus and illustrate the bending resulting from the updraft of air going out the outlet 5, which rapidly brings the yarn to the top of the turbulent air stream.

EXAMPLE 1

Two ends of 400 denier, 100 filament flat polyester yarn were fed through the air jet entangler shown in the drawings with 2% overfeed at an output rate of 390 yds./min. Air pressure was 12 psig. The product was visually uniform and appeared as a single yarn and not as two separate yarns. This same appearance remained when the yarn was used to prepare fabrics, both knitted and woven.

EXAMPLE 2

Two ends of 200 denier, 68 filament flat nylon yarn were fed through the apparatus used in EXAMPLE 1 at 390 yds./min. with a 2% overfeed and an air pressure of 12 psig. An entangled, plied yarn was obtained which was visually uniform.

EXAMPLE 3

The yarn used in this example was 150 denier, 34 filament polyester yarn which had been pretexturized by false twisting. Two ends of this yarn were fed through the apparatus of EXAMPLE 1 at 250 yds./min. with a 2.5% overfeed using an air pressure of 12 psig. A second run was made at a feed of 800 yds/min. with 2.5% overfeed using an air pressure of 40 psig and then the procedure was repeated at 1200 yds./min. 2.5% overfeed and 60 psig air pressure. All the products were visually uniform and appeared as a single yarn.

It will be apparent that many modifications and variations can be effected without departing from the scope of the novel concepts of the present invention and the illustrative details disclosed are not to be construed as imposing undue limitations on the invention.

I claim:

1. An air jet apparatus for the production of entangled yarn comprising a block; a yarn passageway extending therethrough from side to side: means to feed yarn through said passageway: an air inlet duct for introducing air into the passageway, said inlet duct intercepting said passageway at substantially right angles with the longitudinal axis of said inlet passing through or close to the longitudinal axis of the yarn passageway: an air outlet duct intercepting the top of the yarn passageway and slanting upward therefrom and means extending into said yarn passageway between the air inlet duct and the exit end of the yarn passageway to contact yarn fed through said yarn passageway and provide resistance to the movement of said yarn.

2. An apparatus as claimed in claim 1 wherein said means extending into said yarn passageway is a rod.

3. An apparatus as claimed in claim 1 wherein the cross section of the end of the yarn passageway through which the yarn enters is smaller than the cross section of the yarn passageway in the area of the air inlet duct interception.

4. An apparatus as claimed in claim 3 wherein the cross section of the air outlet duct is greater than that of the entrance end of the yarn passageway.

5. An apparatus as claimed in claim 4 wherein the slant of said air outlet duct is in the upstream direction with the axis of the air outlet duct intersecting the axis of the yarn passageway at an angle of about 30° to 75°.

6. A process for entangling the filaments of multifilament yarn comprising feeding one or more multifilament yarns at an overfeed of 0.1% to 10% into a treatment chamber wherein said yarns are subjected to a plural vortex turbulent zone formed in the upper portion of said chamber by a jet of air striking a curved upper wall of said chamber, a portion of the air of said air jet being withdrawn through a duct in the upper part of the treatment chamber to create an airstream which holds the yarns in the upper portion of the treatment chamber in the area of the turbulent zone and pulling said yarns over a smooth surface located in said treatment chamber upstream from said air jet, said surface providing resistance to the forward movement of said yarn thereby forming slack in said yarns in the area of said turbulent zone.

* * * * *